US005330406A

United States Patent [19]

Patterson

[11] Patent Number: 5,330,406

[45] Date of Patent: Jul. 19, 1994

[54] HYDRAULIC EXERCISE APPARATUS

[76] Inventor: Gary W. Patterson, 1061 S. Emerson, Denver, Colo. 80209

[21] Appl. No.: 75,503

[22] PCT Filed: Oct. 15, 1991

[86] PCT No.: PCT/US91/07669

§ 371 Date: Jun. 10, 1993

§ 102(e) Date: Jun. 10, 1993

[51] Int. Cl.[5] ..... A63B 21/008

[52] U.S. Cl. ..... 482/113

[58] Field of Search ..... 482/111, 112, 113, 133, 482/136, 137, 138

[56] References Cited

U.S. PATENT DOCUMENTS

| | | | |
|---|---|---|---|
| 3,128,094 | 4/1964 | Wolf | 482/113 |
| 3,822,599 | 7/1974 | Brentham | 482/113 |
| 4,275,882 | 6/1981 | Grosser et al. | 482/112 |
| 4,397,462 | 8/1983 | Wilmarth | 482/113 |
| 4,465,274 | 8/1984 | Davenport | 482/113 |
| 4,618,140 | 10/1986 | Brown | 482/112 X |
| 4,772,016 | 9/1988 | Manion | 482/112 |
| 4,911,436 | 3/1990 | Lighter | 482/113 |
| 5,058,887 | 10/1991 | Patterson | 482/113 |

FOREIGN PATENT DOCUMENTS 8101662 6/1981 PCT Int'l Appl. ..... 482/112

*Primary Examiner*—Robert Bahr

*Attorney, Agent, or Firm*—J. Preston Oxenham

[57] ABSTRACT

An exercise apparatus (10) includes a hydraulic resistance member (50) with a single sided hydraulic cylinder (53) for pumping fluid through a fluid circuit (80). Lever members (31, 32) pivot in a common plane and extend outward to embrace the hydraulic resistance member (50) between them. Stop members (221,223) limit movement of the lever members (31, 32), and biasing member (230) biases 10 the lever members (31,32) apart. An immobilizing member (40) may selectively immobilize either one of the lever members (31, 32). An extension arm (17) supports an exercise member (16) which may move along an exercise stroke only by pumping cylinder (53). The fluid circuit (80) allows fluid to flow from the cylinder (53) only when pressure in the cylinder (53) exceeds a selected pressure corresponding to a selected exercising force determined in accordance with the position of the member (16) along the exercise stroke by a control linkage (100). During the return stroke, no exercising force is required.

6 Claims, 7 Drawing Sheets

HYDRAULIC EXERCISE APPARATUS

TECHNICAL FIELD

The present invention relates to apparatus for providing resistive forces against which muscles of the human body may be dynamically exercised and, most particularly, to universal gym type exercise devices which provide such resistive forces for a large number of different exercises by means of hydraulic cylinders.

BACKGROUND OF THE INVENTION

Prior to the advent of modern exercise machines and universal gyms, iron weights, used in combination with bars as bar bells or dumb bells and lifted against gravity, were the most common resistance medium against which muscles were worked for exercise. Such free weight exercise apparatus has many disadvantages. There is a danger of loss of control of the weight due to fatigue or an attempt to lift more weight than the muscles are capable of controlling. Much time is required for changing weights and moving weights and auxiliary equipment in preparation for different exercises. Equipment for an extensive and thorough fitness program constitutes a great number of separate parts, including weights and bars to be organized and stored.

contemporary exercise and universal gym devices continue to use weights made of iron or other heavy material to provide resistance for muscle exercise, but confine the weights to movement along fixed tracks to eliminate dangers of loss of control or dropping of free weights. The weights of these apparatus are connected by chains and levers in various configurations, to exercise members which are engaged and worked by an exercising athlete. These machines may provide changing mechanical advantage through the exercise stroke to maximize exercise benefit. However, such machines suffer from a number of disadvantages. They must be massive, to provide the weight necessary for training advanced athletes and to provide necessary structural strength, and they are complex, because all exercise motions must be translated into up and down movement of the weights along their tracks. This latter consideration generally precludes any single machine from providing a sufficient number of different conditioning exercises for a complete fitness program.

Efforts to reduce the mass and complexity of exercise machines and universal gyms have resulted in a number of apparatus utilizing hydraulic resistance. Generally, these apparatus have two key elements in common; a hydraulic cylinder linked to an exercise member to pump fluid in and out of the cylinder in response to movement of the exercise member, and a means for creating resistive pressure in the cylinder against which the muscles are worked. Despite their large number, all such machines are deficient in one or more respects. Most utilize double-action hydraulic cylinders and, unlike free weights, provide exercising forces which resist movement of the exercise member during both an exercise stroke and a return stroke of an exercise cycle. This "two-way resistance" does not provide the benefits of free weight exercise which provides no resisting force during the return stroke.

Many hydraulic exercise devices of the present art do not provide a sufficient number of exercises for true muscle conditioning program versatility. Many of these machines utilize multiple hydraulic cylinders in an attempt to provide a sufficient number of different exercises, further increasing their mass and complexity. Generally, substantial time and effort is required to change between exercising configurations of these apparatus. None of these devices provide for controlled variation of exercise resistance over the exercise stroke to provide optimum exercise benefit.

DISCLOSURE OF THE INVENTION

It is an object of the present invention to provide a versatile exercise apparatus utilizing hydraulic resistance, which can provide benefits of exercise with free weights.

It is also an object to allow quick and easy change among a large number of exercise configurations.

It is a further object of the invention to provide selective control of the exercise resistance in accordance with the position of the exercise member over the exercise stroke.

Yet another object is to allow the level of exercise resistance to be quickly and easily changed.

In accordance with the above objectives, an exercise apparatus of the present invention includes a hydraulic resistance member including a fluid circuit and a single sided hydraulic cylinder having an actuator and a piston, for pumping fluid through the fluid circuit. An exercising member is provided which is movable through an exercise cycle, including an exercise stroke and a return stroke, and linked to the actuator such that the exercise member may move along the exercise stroke only by causing pumping movement of the piston. The fluid circuit includes first valve means for allowing fluid to flow from the pump, through a first portion of the fluid circuit, only when upstream pressure exceeds a selected pressure such that the exercise member can move along the exercise stroke only when exercising force exceeds a selected force. A preferred embodiment includes pressure control means for determining the selected pressure in accordance with the position of the exercise member along the exercise stroke. The fluid circuit also includes a second fluid valve means for allowing fluid to flow freely through a second portion of the fluid circuit so that no exercising force is required during the return stroke.

First and second lever members are pivotally attached to a carrier, which may be fixed in various positions along a support member, and pivot in a common plane with the support member. The lever members extend outwardly and away from the support member to embrace the hydraulic resistance member between them. An extension arm may be inserted into either lever member to support the exercise member. An immobilizing member may be releasably attached to a selected one of the lever members to immobilize it.

In an alternative embodiment, the carrier includes first and second stop members to limit pivotal movement of the first and second lever member, respectively, away from the other lever member. A biasing member is mounted between the lever members to resiliently bias the lever members, one away from the other.

Other objects, advantages and aspects of the invention will become apparent upon reading of the following detailed description and claims and upon reference to the accompanying drawings.

DETAILED DESCRIPTION OF THE INVENTION

Figure 1:
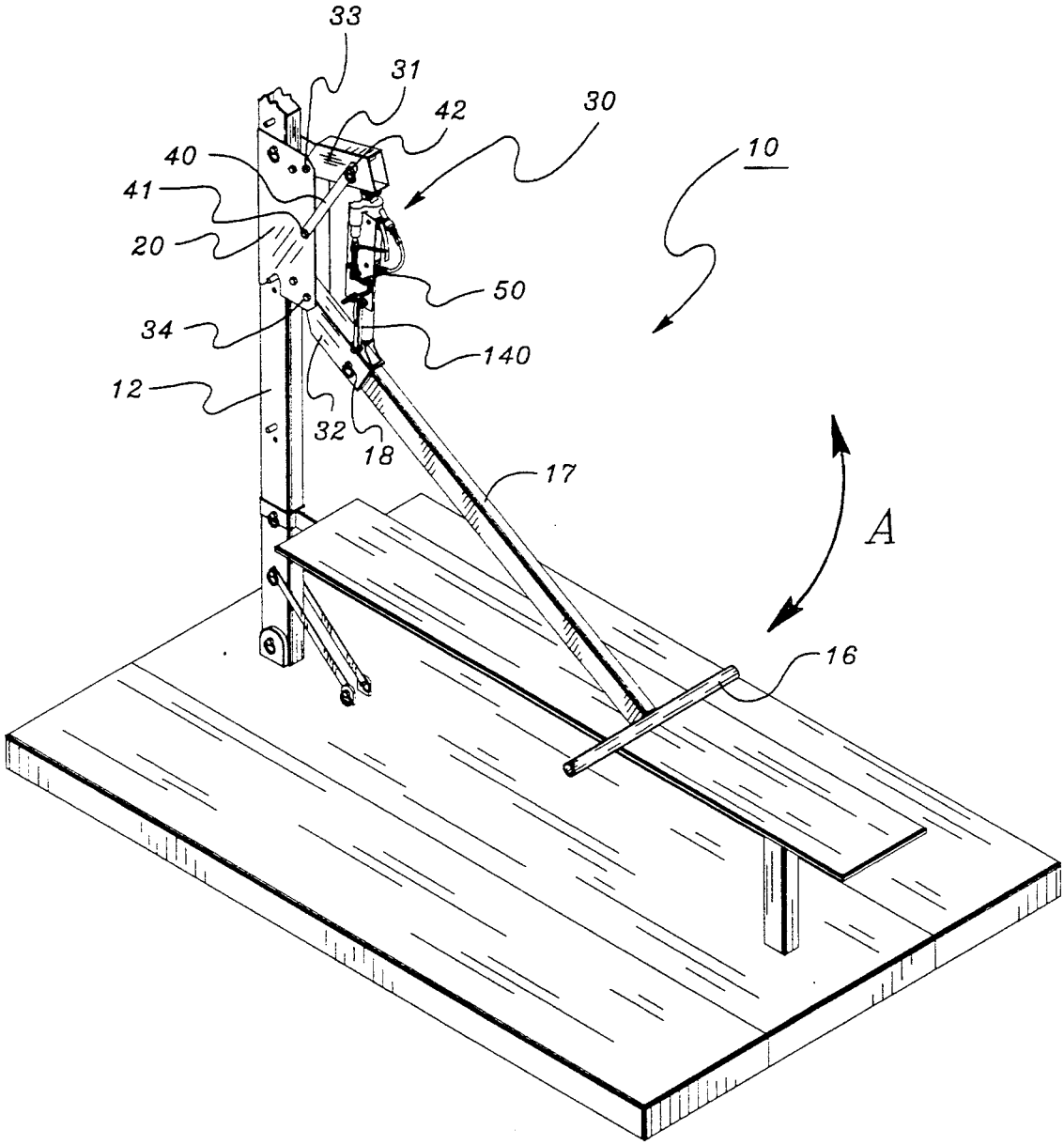
FIG. 1 is an isometric pictorial view of a hydraulic exercise apparatus comprising a preferred embodiment of the present invention.
Figure 2:
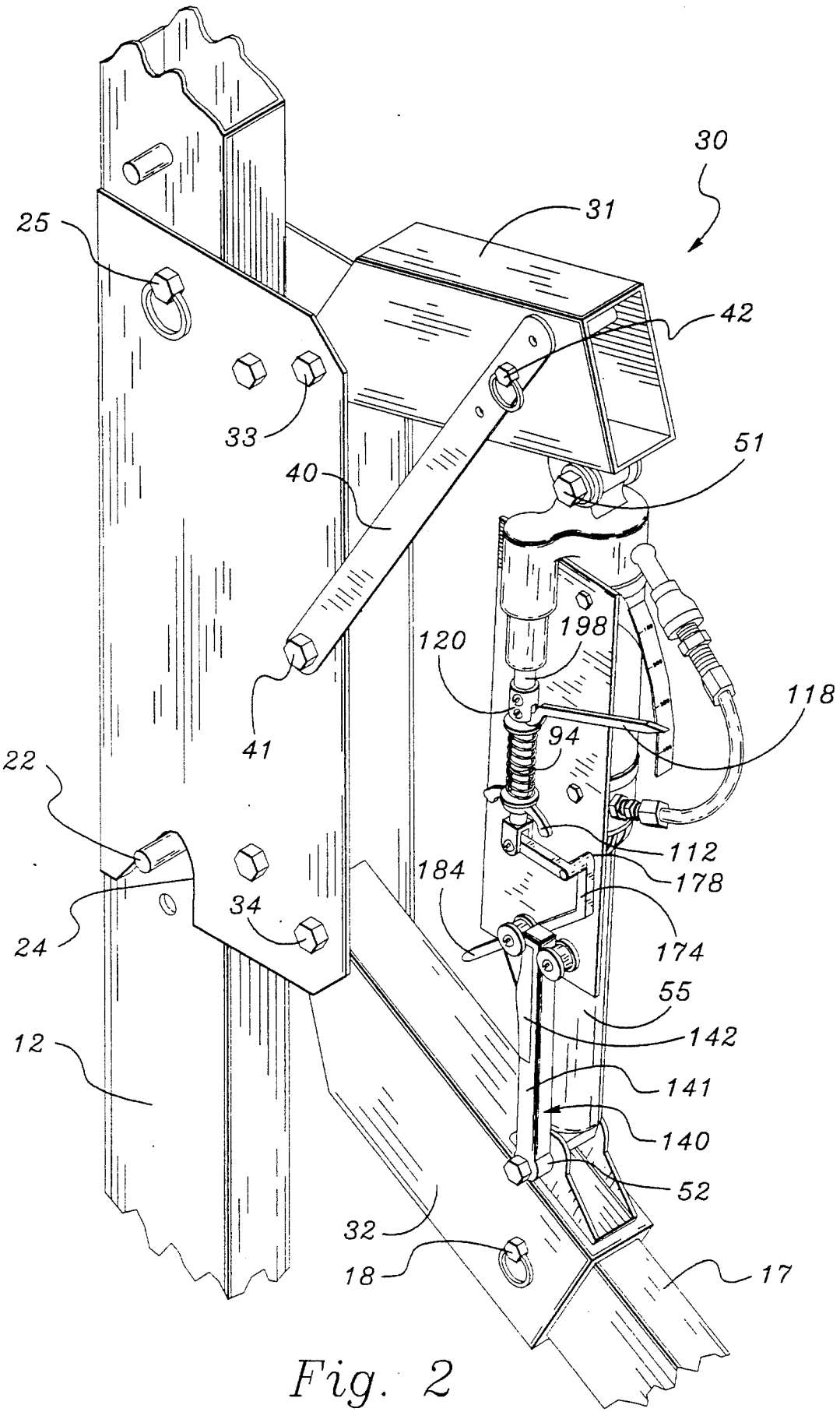
FIG. 2 is an isometric pictorial view, close-up, of the hydraulic resistance assembly of the exercise apparatus of FIG. 1.

Hydraulic exercise apparatus 10 comprising the invention is shown in FIG. 1 and includes support member 12 mounted on base 14. Hydraulic resistance assembly 30 is mounted on support member 12 by means of carrier 20. As best seen in FIG. 2, hydraulic resistance assembly 30 also includes first and second lever members 31, 32 rotatably attached to carrier 20 at pivot points 33, 34, respectively. Lever members 31, 32 extend outwardly and away from support member 12 and carrier 20 to distal free ends and embrace hydraulic resistance member 50, which is pivotally attached to lever members 31, 32 at 51, 52, respectively. Lever members 31, 32 may pivot about pivot points 33, 34, respectively, in a common plane with support member 12.

In the embodiment of FIG. 1, immobilizing member 40 is rotatably attached to carrier 20 at pivot point 41 located midway between lever member attachment points 33 and 34. Immobilizing member 40 may be attached to a selected one of lever members 31, 32 by passing immobilizing pin 42 through aligning holes in member 40 and the selected lever member thus immobilizing it.

Lever members 31, 32 are formed as hollow beams to facilitate attachment of devices, such as extension member 17, shown in FIG. 1 inserted into lever member 32 and held in place by pin 18 passing through aligning holes in the extension and lever member. Extension member 17 extends outwardly from hydraulic resistance assembly 30 to support exercise member 16 is attached.

Figure 3:
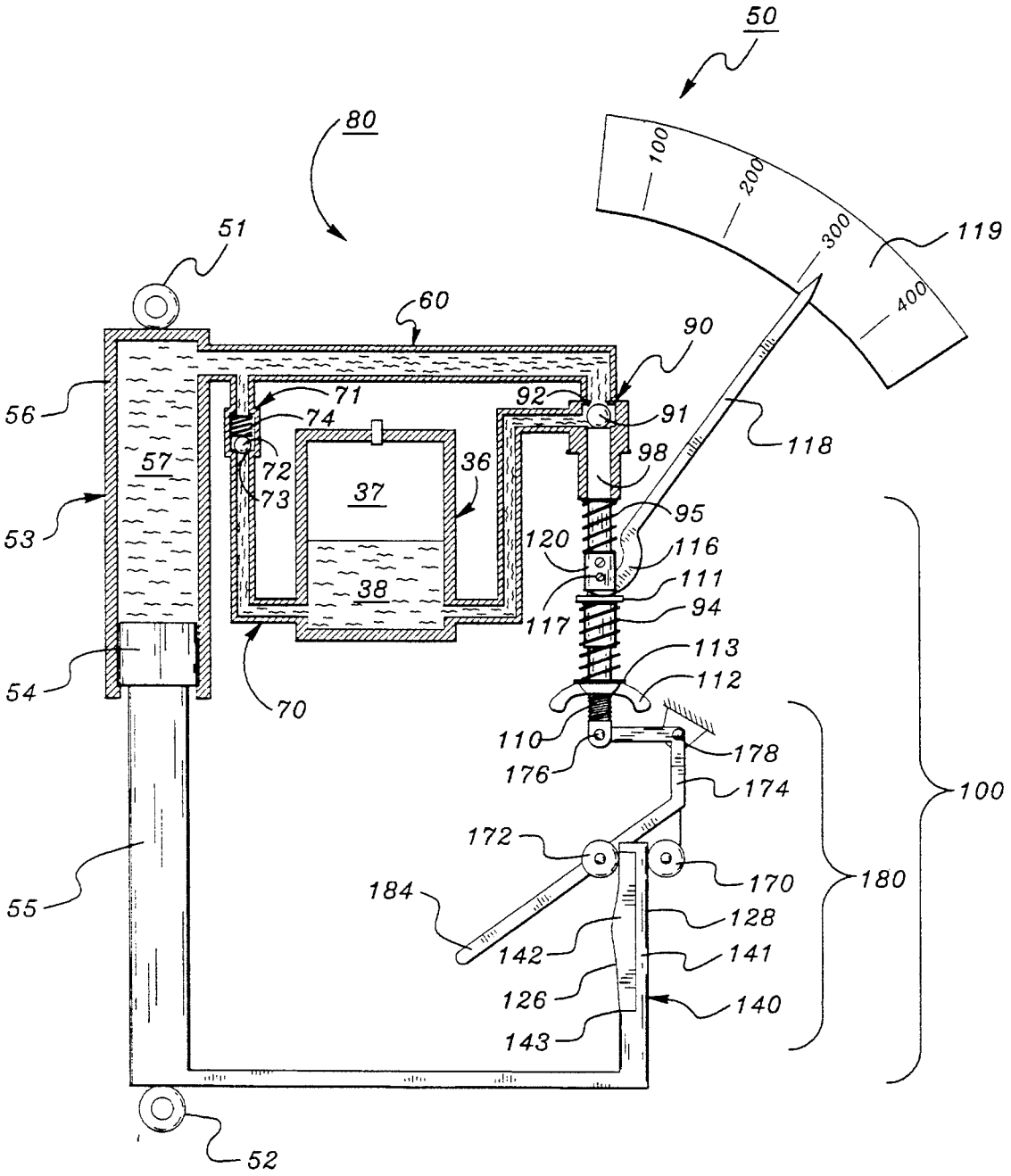
FIG. 3 is a schematic representation of the fluid circuit of the hydraulic resistance member of the exercise device of FIG. 1.

As best seen in the schematic illustration of FIG. 3, hydraulic resistance member 50 includes a single sided hydraulic cylinder 53 with piston 54 slidably retained in housing 56 to form hydraulic chamber 57 which is in fluid communication with fluid circuit 80. Fluid circuit 80 includes reservoir 36 for containing a variable amount of hydraulic fluid 38. When sufficient force is exerted upon actuator portion 55, piston 54 is caused to slide within housing 56, decreasing or increasing the volume of hydraulic chamber 57 to pump hydraulic fluid from chamber 57 through fluid circuit 80 to reservoir 36, or to draw fluid from reservoir 36 through fluid circuit 80 into chamber 57, respectively.

Referring to FIG. 1, it will now be understood that, with lever member 31 immobilized, when exercise member 16 is moved upward and downward through an exercise cycle, along an arc, as indicated by arrow A, piston 54 is caused to move within housing 56, to pump fluid into, and draw fluid from reservoir 61, respectively. Further, the force which must be exerted upon exercise member 16 to move member 16 through the exercise cycle will be proportional to the pressure of the hydraulic fluid within hydraulic chamber 57.

Fluid circuit 80 includes first fluid passage 60 leading from chamber 57 to reservoir 36, and second fluid passage 70, leading from reservoir 36 to pressure chamber 57. Check valve 71 is interposed in second fluid passage 70 to allow fluid to flow only in the direction from reservoir 36 to chamber 57. Check valve 71 is a ball type check valve comprising ball element 72 held against seat 73 by spring 74.

Pressure control valve 90 is interposed in first fluid flow passage 60 and comprises spherical valve element 91 which is urged against seat 92 by valve spring 94 acting through pushrod 98. Thus, pressure control valve 90 will allow fluid to flow from chamber 57 through first fluid flow passage 60 to reservoir 36 only when the fluid pressure in chamber 57 exceeds the pressure in reservoir 61 by an amount sufficient to lift element 91 from seat 92 in opposition to the seating force exerted upon element 91 by pushrod 98. Valve seat 92 is of sufficient size to allow fluid to flow freely once the seating force is overcome.

The amount by which the pressure in chamber 57 must exceed the pressure in reservoir 36 before fluid may flow from chamber 51 to reservoir 36 is determined by control assembly 100. The biasing force which urges valve element 91 against seat 92 is provided by helical valve spring 94 surrounding threaded adjustment rod 110 and compressed between valve-side spring support 111 and base spring support 113. The upper end of adjustment rod 110 is inserted telescopically into a cylindrical cavity in pushrod 98 and is sized to slide freely within the cavity. Base support 113 surrounds adjustment rod 110 and is sized to move freely along a portion of its length. Wing nut 112 cooperates with threaded adjustment rod 110 to allow the compression length of valve spring 94 and, thus, the nominal biasing force exerted by valve spring 94 upon push rod 98 and valve element 91, to be adjusted. Valve-side spring support 111 surrounds adjustment rod 110, and may move freely along a portion of its length. Selection cam 116 is pivotally attached at 117 to support 120 at the lower end of pushrod 98, and may be rotated about pivot point 117 by means of adjustment lever 118. Selection cam 116 acts against valve-side spring support 111 to hold valve-side spring support 111 against the force of valve spring 94 at a selected longitudinal position along adjustment rod 110. In this manner, valve side spring support 111 may be moved to select a base level biasing force which holds valve element 91 against valve seat 92. An index scale, 119, may be provided to cooperate with adjustment lever 118 to indicate the magnitude of the base level bias force.

With selection lever 118 set at the desired position, when exercise member 16 is urged upwardly, force is transmitted by extension member 17 and lever member 32 to actuator portion 55 of piston 54 at attachment point 52 to increase the pressure of hydraulic fluid in chamber 57. However, no motion of exercise member 16 can occur until the pressure in chamber 57 becomes sufficient to cause fluid to flow from chamber 57 through passage 60 to reservoir 36. When sufficient exercising force is applied, exercise member 16 will move through an exercise stroke providing an exercising force as fluid is pumped from chamber 57 to reservoir 36. When exercise member 16 is moved through a return stroke, pressure control valve 90 acts as a check valve to prevent return of fluid from reservoir 36 to chamber 57 through passage 80. However, check valve 71 will open to allow fluid to return to chamber 57 from reservoir 36 through flow passage 70 with very little pressure drop as piston 54 moves downward, thus requiring only very little force to move exercise member 16 during the return stroke. Thus exercise apparatus 10 provides independent exercise of individual muscle groups, as with free weight and weight based gyms, separating periods of high exertion exercise strokes with low effort return strokes.

Hydraulic exercise apparatus 10 also provides for continuous, controlled adjustment of the biasing force exerted by valve spring 94 upon element 91, and thus the exercising force required to move exercise member 16, throughout the exercise stroke.

As may be seen in FIGS. 2 and 3, this is accomplished by exercising force control cam 140 and linkage assembly 180. Linear cam 140 is mechanically linked to actuator portion 55 of piston 54 to move proportionally with movement of exercise member 16. Linear cam 140 includes carriage portion 141 and control portion 142, and lies between support roller 170 and follower roller 172. Control portion 142 is removably insertable in carriage portion 141 and control portions having control surfaces 126 of differing profiles may be substituted, as appropriate, for differing exercise use. Follower roller 172 is linked to adjustment rod 110 by bellcrank 174 upon which follower roller 172 is rotatably mounted. Bellcrank 174 is pivotally mounted at fulcrum point 178 and pivotally attached to the base of adjustment rod 110 at 176. Thus, following roller 172 is held against control surface 126 by the biasing force of valve spring 95. As actuator 55 and piston 54 move through an exercise stroke, linear cam 140 will move between support roller 170 and follower roller 172, and, at each point along the exercise stroke, the distance between support roller 170 and follower roller 172 will be determined by the local width of cam 140. Thus, adjustment rod 110 will be moved telescopically within pushrod 98, changing the compression length of spring 94 and, thus, the biasing force applied to pushrod 98 and the magnitude of the exercising force necessary to move piston 54 to decrease the volume of chamber 57. For example, as the distance between rollers 170 and 172 is increased, linking member 174, as shown in FIG. 3, is caused to rotate clockwise and cause adjustment rod 110 to telescope upward into pushrod 98, shortening spring 94 and increasing the biasing force acting on valve element 91 and the exercising force which must be exerted. Different control portions 142 having different exercising force control profiles may be inserted into carrier portion 140 to alter the pattern of resistance during the exercise stroke. This continuous exercise force adjustment feature allows the benefits of certain exercise cycles to be maximized by compensating for changing mechanical advantage of an athlete's musculoskeletal structure relative to the resistance member during the exercise stroke of certain exercise routines. Lift handle 184 allows follower roller 172 to be raised form control surface 126 to facilitate removal and replacement of control portions 142.

Figure 4:
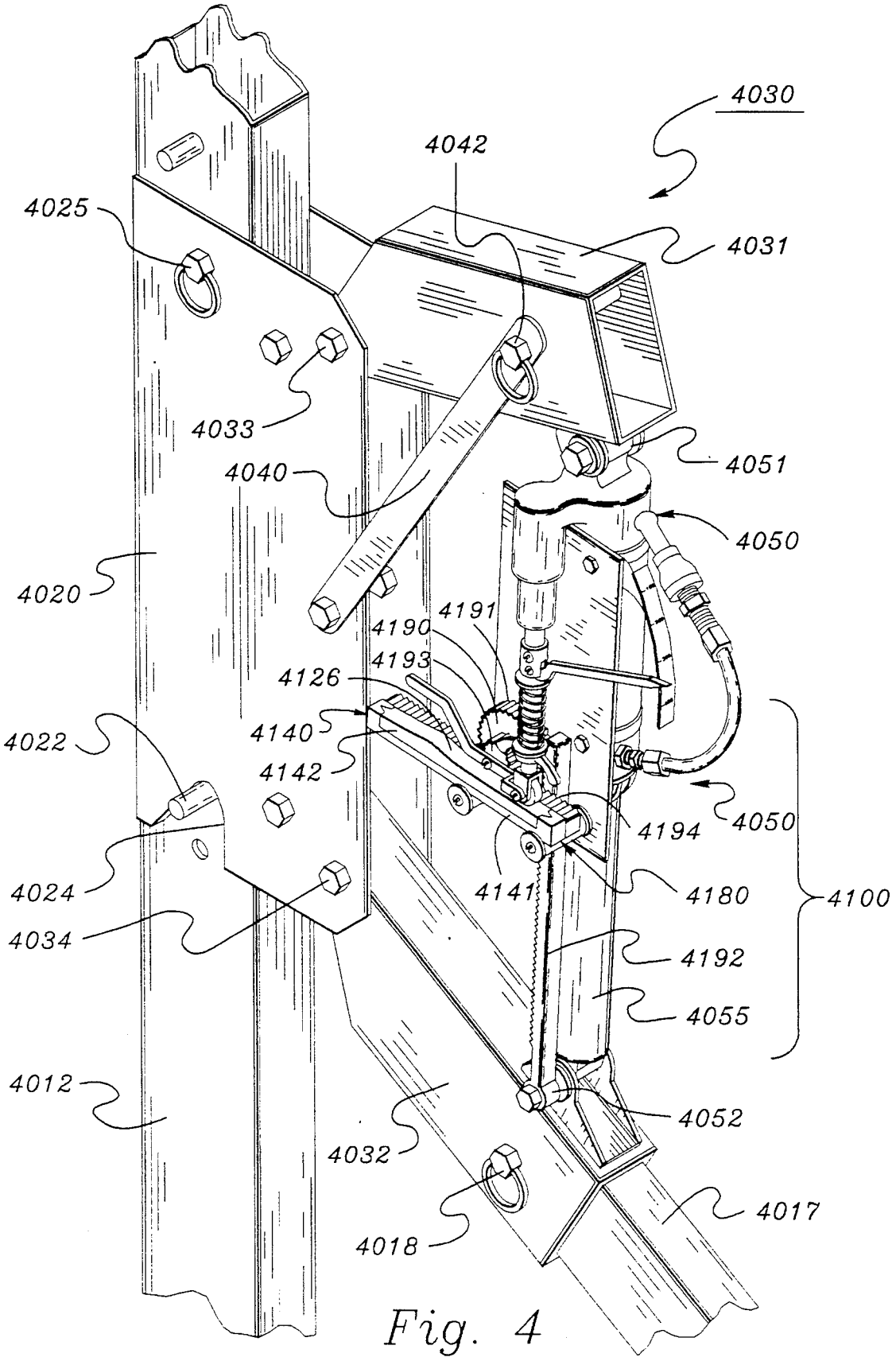
FIG. 4 is an isometric pictorial view of the hydraulic resistance assembly of an exercise apparatus comprising a second embodiment of the invention.

Linkage assembly 4180 of control assembly 4100 of a second embodiment of FIG. 4 differs from that of the first embodiment by introduction of gear 4190 and first and second gear racks 4192, 4194. First gear rack 4192 is fixed to actuator 4055 to move upward with actuator 4055 during an exercise stroke. Rack 4194 is attached to carrier portion 4141 of linear cam 4140 to cause cam 4140 to move with rack 4194 as a unit. Gear member 4190 is rotatably mounted with first set of gear teeth 4191 engaged with first gear rack 4192 and second set of gear teeth 4192 engaged with second gear rack 4194 such that second gear rack 4194 is moved longitudinally in proportion to longitudinal movement of first rack 4192. Control portion 4142 of linear cam 4140 lies directly beneath roller 4172 which is mounted directly upon the end of adjustment rod 4110 such that roller 4172 is biased directly against control surface 4126. Thus, the compression length of spring 4094, and the biasing force exerted by spring 4094 on valve element 4091, are determined, in part, by the contour of control surface 4126 to control the corresponding exercising force which must be exerted upon exercise member 16 at each point along the exercise stroke.

Those familiar with the art will recognize that there are many well known types of linkage assemblies which can link pressure control valve 90 to the position of actuator 54, including electronic controls, hydraulic and other mechanical linkages.

Figure 5:
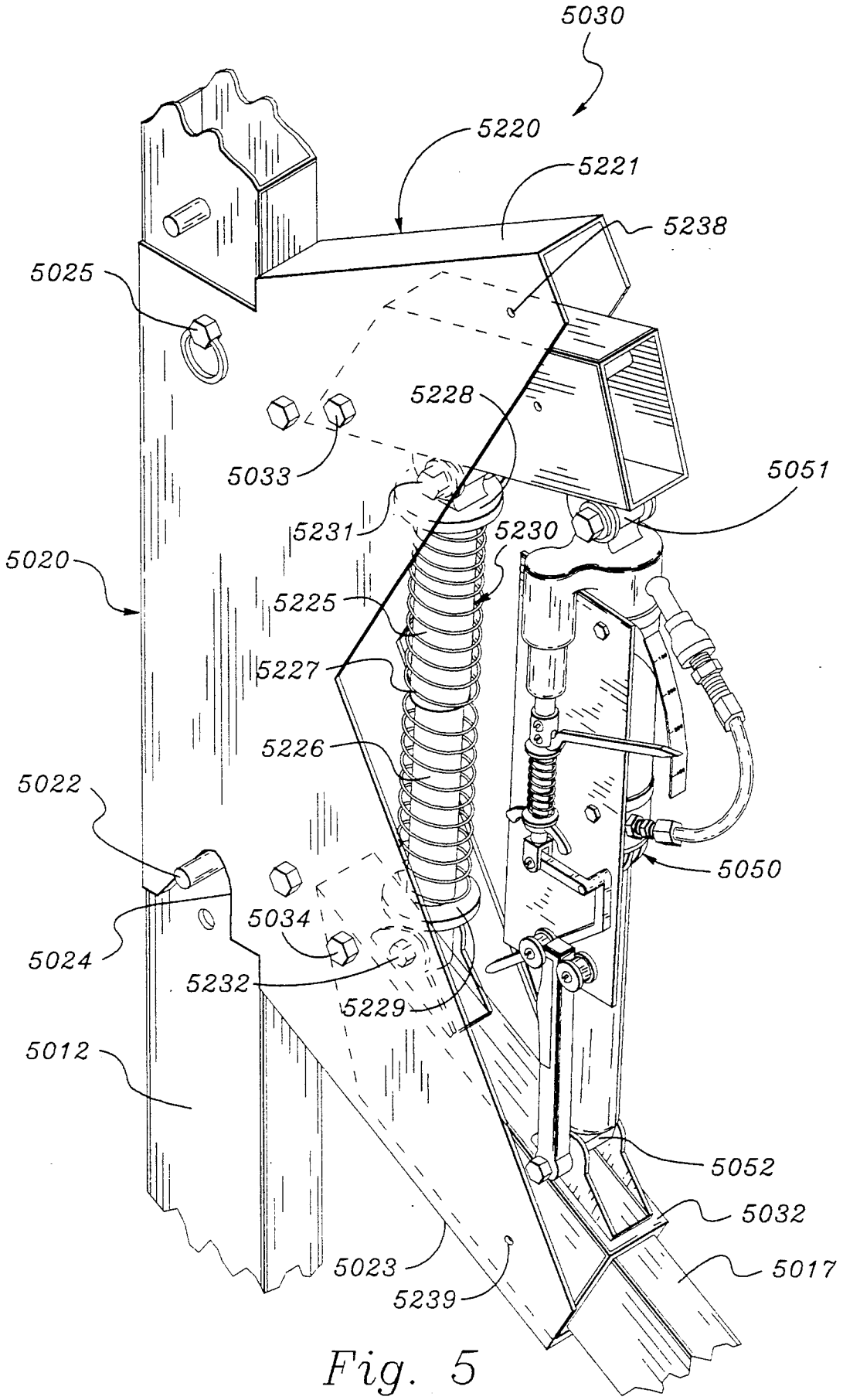
FIG. 5 is an isometric pictorial view of the hydraulic resistance assembly of an exercise apparatus comprising a third embodiment of the invention.

An alternative embodiment of the present invention is shown in FIG. 5. In that embodiment, carrier 5020 comprises a saddle like portion 5220 including first stop member 5221 and second stop member 5223 located above first lever member 5031 and below second lever member 5032, respectively. Biasing member 5240 of that embodiment includes telescoping sections 5225 and 5226 and spring member 5227 compressed between spring stops 5228 and 5229, fixed to sections 5225 and 5226, respectively, and exerts an outward biasing force upon lever members 5031, 5032 at rotational attachment points 5231, 5232, respectively. The biasing force of biasing member 5240 is selected to be just sufficient to overcome any nonexercising resistance of hydraulic resistance member 5030 to movement of lever members 5031, 5032 away from one another following compression of resistance member 5030 during an exercise stroke. This arrangement avoids the need to change the position of an immobilizing member when switching between exercise configurations requiring movement of opposite lever members. A U-shaped leaf-type spring fixed between lever members 5031, 5032, or other alternative spring device, may also be employed as the biasing member. Stop members 5221 and 5223 of carrier saddle 5020 are provided with locking holes 5238 and 5239, respectively. A pin can be passed through these holes and matching holes in an lever members 5031, 5032 to lock the member in place as necessary for certain exercise configurations.

As seen in FIG. 2, carrier 20 is mounted on support member 12 by engaging one of peg pairs 22 in carrier mounting slots 24 and then placing mounting pin 25 through aligning holes in carrier 20 and support 12. Thus, carrier 20 may be positioned at different locations on support member 12 and extension 17 inserted in either of lever members 31, 32 to allow a great variety of exercises to be performed. Further, the immobilized lever member may serve to mount various accessories to provide still further versatility.

Figure 6:
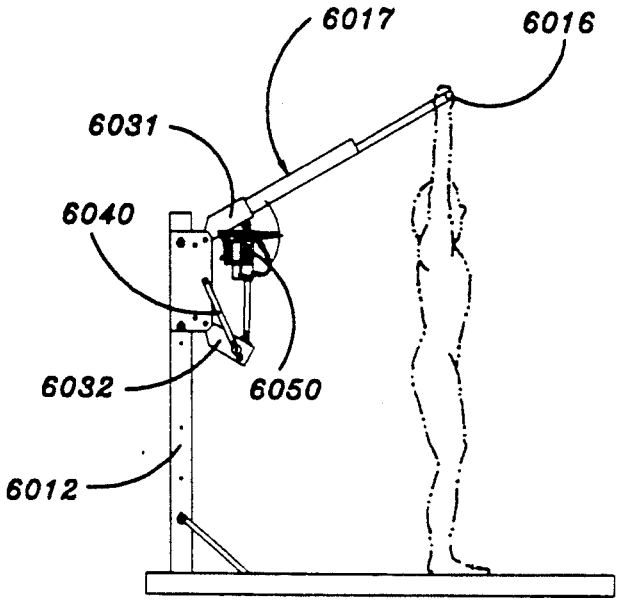
FIG. 6 is a side elevation of an exercise apparatus comprising the present invention in a configuration for lateral, chin-up and pull-down exercises.
Figure 7:
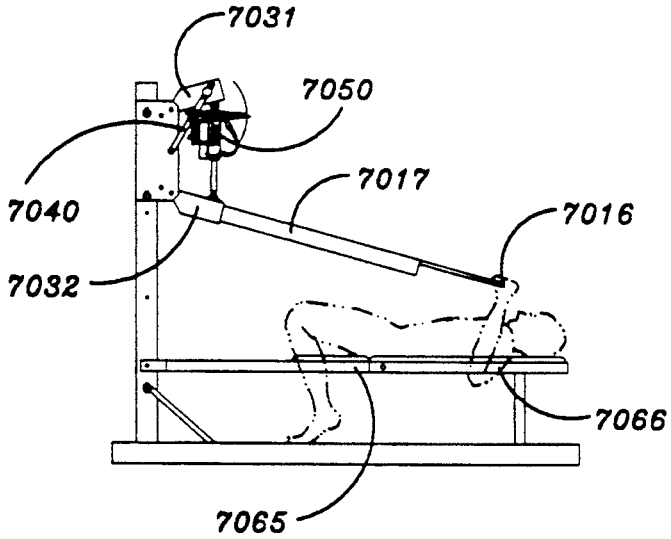
FIG. 7 is a side elevation of an exercise apparatus comprising the present invention in a configuration for bench press, overhead press and behind head triceps exercises.
Figure 8:
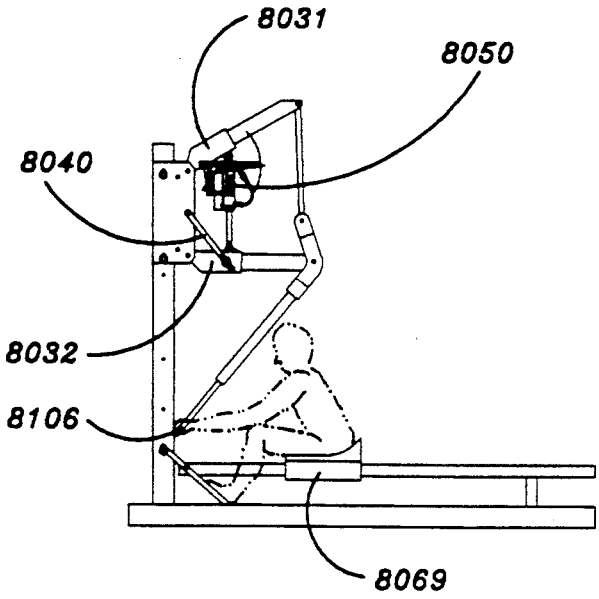
FIG. 8 is a side elevation of an exercise apparatus comprising the present invention in a configuration for rowing exercise.

For example, exercise apparatus 6010 of FIG. 6 is shown in configuration for lateral pull down exercises. Lever member 6032 is immobilized by engagement with immobilizing member 6040 and extension member 6017 is inserted in lever member 6031. In this configuration, an exercising athlete pulls exercise member 6016 downward through exercise strokes of repetitive up-and-down exercise cycles. FIG. 7 shows exercise apparatus 7010 in configuration for bench press, overhead press and behind-the-head triceps exercises. Exercise apparatus 8010 of FIG. 8 is configured for rowing exercises in which exercise member 8016 is drawn away from support member 8012 during exercise strokes compressing resistance member 8050. From these examples, it will be realized that many configurations are possible to exercise all of the various mussel groups in complete and exhaustive conditioning programs accomplished with this one exercise apparatus.

While an exemplary hydraulic resistance exercise apparatus comprising a preferred embodiment of the invention has been shown, it will be understood, of course, that the invention is not limited to that embodiment. Modification may be made by those skilled in the art, particularly in light of the foregoing teachings. Therefore, it is contemplated by the appended claims to cover any such modification which incorporates the essential features of the invention or encompasses the true spirit and scope of the invention.

I claim:

1. A hydraulic exercise apparatus comprising:

a support member having a longitudinal support member axis;

a carrier mounted upon said support member and having a carrier axis parallel to said support member axis;

first and second lever members pivotally attached to said carrier at a first and second hinge point, respectively, said first and second hinge points separated by a distance along said carrier axis, said first and second lever members extending outwardly away from said carrier to a first and second free distal end, respectively, and having a first and second longitudinal lever member axis, respectively, such that said first and second lever member axes are pivotable in a common plane;

first and second stop members rigidly attached to said carrier and extending outwardly away from said carrier to confine said first and second lever members therebetween and limit pivotal movement of said first and second lever member, respectively, away from the other lever member;

a hydraulic resistance member having a first end portion and a second end portion defining a longitudinal resistance member axis, said first and second end portions movable toward one another along said axis when so urged by a force greater than a pre-selected force, said first end portion pivotally attached to said first lever member at a point lying between said first hinge point and said first free distal end, and said second end portion pivotally attached to said second lever member at a point lying between said second hinge point and said second free distal end; and, a biasing member having a first end portion and a second end portion, said first end portion attached to said first lever member and said second end portion attached to said second lever member to resiliently bias said first and second lever members away from one another.

2. A hydraulic exercise apparatus as in claim 1, further comprising:

first releasable attachment means for releasably attaching said first lever member to said first stop member; and, second releasable attachment means for releasably attaching said second lever member to said second stop member.

3. A hydraulic exercise apparatus as in claim 1 in which said carrier is releasably mounted upon said support member such that said carrier may be moved from one point to another point along said support member axis.

4. A hydraulic exercise apparatus as in claim 1 in which said hydraulic resistance member comprises:

a fluid reservoir;

hydraulic pump means for pumping fluid in response to movement of said first and second end portions one relative to the other, a force required to cause said pumping movement being dependent upon a pressure of the fluid pumped;

a fluid circuit connecting said pump to said reservoir;

first valve means for allowing fluid to flow through said circuit from said pump to said reservoir only when a fluid pressure at an upstream side of said valve exceeds a selected pressure; and pressure control means for determining said selected pressure in accordance with the position of said end portions one relative to the other.

5. An exercise apparatus as in claim 4, in which said fluid circuit further includes a second valve which allows fluid to flow freely through said fluid circuit from said reservoir to said pump only during movement of said first and second end portions one away from the other whereby no force is required to move said first and second and portions one away from the other.

6. A hydraulic exercise apparatus as in claim 5 in which said carrier is releasably mounted upon said support member such that said carrier may be moved from one point to another point along said support member axis.

* * * * *